US011375874B2

(12) United States Patent
Feddema et al.

(10) Patent No.: US 11,375,874 B2
(45) Date of Patent: Jul. 5, 2022

(54) DISHWASHER WITH A DISH RACK AND UTENSIL CADDY

(71) Applicant: Whirlpool Corporation, Benton Harbor, MI (US)

(72) Inventors: Mark S. Feddema, Kalamazoo, MI (US); William J. Snell, Elkhart, IN (US); Sachie Kakehi, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 24 days.

(21) Appl. No.: 16/833,984

(22) Filed: Mar. 30, 2020

(65) Prior Publication Data

US 2021/0298561 A1 Sep. 30, 2021

(51) Int. Cl.

| | |
|---|---|
| ***A47L 15/42*** | (2006.01) |
| ***A47L 15/46*** | (2006.01) |
| ***A47L 15/50*** | (2006.01) |

(52) U.S. Cl.

CPC ..... *A47L 15/502* (2013.01); *A47L 15/4221* (2013.01); *A47L 15/4246* (2013.01); *A47L 15/46* (2013.01)

(58) Field of Classification Search

CPC .. A47L 15/4221; A47L 15/4246; A47L 15/46; A47L 15/502

USPC ..... 134/56 D, 57 D, 58 D, 92, 200

See application file for complete search history.

(56) References Cited

U.S. PATENT DOCUMENTS

| | | | | |
|---|---|---|---|---|
| 2,527,178 | A | 10/1950 | Elsaesser | |
| 8,168,006 | B2 | 5/2012 | Bengston et al. | |
| 9,901,240 | B2 | 2/2018 | Lee | |
| 2006/0237051 | A1* | 10/2006 | Bengston | A47L 15/503 134/56 D |
| 2015/0245762 | A1 | 9/2015 | Tuller | |
| 2018/0242816 | A1 | 8/2018 | Cao et al. | |
| 2019/0290094 | A1 | 9/2019 | Balinski et al. | |
| 2019/0298146 | A1 | 10/2019 | Gutkowski | |

FOREIGN PATENT DOCUMENTS

| | | | |
|---|---|---|---|
| BR | 112018070373 | A2 | 1/2019 |
| CN | 105496336 | A | 4/2016 |
| CN | 109475265 | A | 4/2016 |
| CN | 105559725 | A | 5/2016 |
| CN | 205697665 | U | 11/2016 |
| CN | 109259690 | A | 1/2019 |
| DE | 102013213612 | A1 | 1/2015 |
| DE | 102014208843 | A1 | 11/2015 |

(Continued)

OTHER PUBLICATIONS

European Patent Office, Extended European Search Report re Corresponding Application No. 21166056.8-1016, dated Aug. 10, 2021, 7 pages, Munich, Germany.

*Primary Examiner* — Levon J Shahinian

(74) *Attorney, Agent, or Firm* — McGarry Bair PC

(57) ABSTRACT

An automatic dishwasher configured to implement an automatic treating cycle of operation, comprising a tub defining a dish treating chamber, a dish rack located within the dish treating chamber, and a utensil caddy removably mounted to the dish rack. The utensil rack including a first set of utensil holders provided on a first side wall of the utensil caddy and a second set of utensil holders provided on a second side wall of the utensil caddy.

19 Claims, 9 Drawing Sheets

(56) References Cited

FOREIGN PATENT DOCUMENTS

| | | | |
|---|---|---|---|
| DE | 102017200272 | A1 | 7/2018 |
| EP | 0963733 | A1 | 12/1999 |
| EP | 3439527 | A1 | 2/2019 |
| FR | 2643809 | A1 | 9/1990 |
| WO | 2014094897 | A1 | 6/2014 |
| WO | 2017176286 | A1 | 10/2017 |

* cited by examiner

DISHWASHER WITH A DISH RACK AND UTENSIL CADDY

TECHNICAL FIELD

This disclosure generally relates to a dishwasher, and more specifically to dishwasher including a utensil caddy mounted to a dish rack.

BACKGROUND

Household dishwashers typically include one or more dish racks for holding various types of dishes in the dishwasher tub. Traditionally, a dishwasher includes an upper dish rack that holds glassware and small dishes, and a lower dish rack that holds larger dishes, such as plates. The upper and lower dish racks usually consume most of the space inside the dishwasher tub. Some dishwashers can also include a third dish rack, often referred to as a third level rack, of a much shorter height the upper and lower dish racks, with the height being such as to only accommodate silverware or other low profile utensils.

A utensil caddy is often used to specifically hold silverware. Utensil caddies are normally removably carried by the lower dish rack or on the inner surface of the door closing the dishwasher. These utensil caddies are oriented such that they hold the utensils in an upright or vertical orientation during washing.

Some dishwashes can have both a utensil caddy and a third level rack. The third level rack can normally accommodate long handle items, such as spatulas, severing spoons, stirring spoons, which, if put into the utensil caddy, would extend far enough vertically to interfere with the rotation of the sprayer below the upper rack.

SUMMARY

In one aspect, the present disclosure relates to an automatic dishwasher configured to implement an automatic treating cycle of operation, comprising a tub defining a dish treating chamber, a dish rack located within the dish treating chamber and comprising a bottom wall defining at least one plane, a utensil caddy, removably mounted to the dish rack, and comprising a periphery defining an interior with a top, the periphery having at least first and second opposing side walls, the first side wall abutting the bottom wall, and the second side wall movable relative to the utensil caddy between a first position, in opposition to the first side wall, and a second position, abutting the bottom wall, a first set of utensil holders provided on the first side wall, and a second set of utensil holders provided on the second side wall.

In another aspect, the present disclosure relates to an automatic dishwasher configured to implement an automatic treating cycle of operation, comprising a tub defining a dish treating chamber, a dish rack located within the dish treating chamber and comprising a bottom wall defining at least one plane, a first set of cup seats provided in the bottom wall, a utensil caddy, removably mounted to the dish rack, and comprising a periphery defining an interior with an open top, the periphery having at least first and second opposing side walls, the first side wall abutting the bottom wall, and the second side wall movable relative to the utensil caddy between a first position, in opposition to the first side wall, and a second position, abutting the bottom wall and overlying at least some of the cup seats in the first set of cup seats.

DESCRIPTION OF EMBODIMENTS OF THE INVENTION

Aspects of the present disclosure relate to a utensil caddy including on a dish rack of dishwasher, specifically an automatic dishwasher. The utensil caddy can be configured to include, at least, a first side wall including a first set of utensil holders and a second side wall including a second set of utensil holders. The second side wall can be further configured to be moveable relative to the utensil caddy between a first position and a second position.

Figure 1:
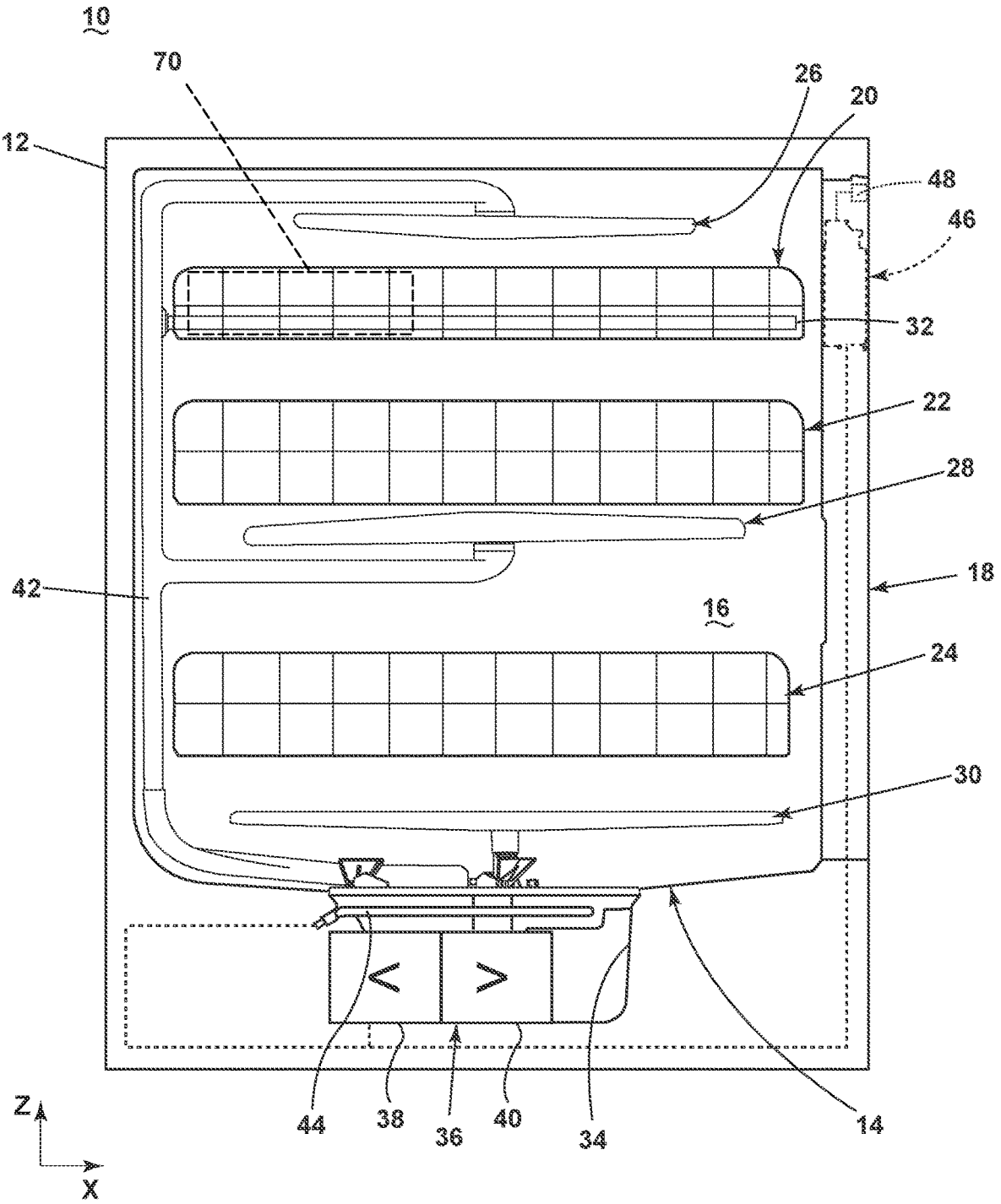
FIG. 1 is a schematic, cross-sectional view of a dishwasher with a dish rack according to an aspect of the present disclosure.

FIG. 1 illustrates a schematic, cross-sectional view of an exemplary dishwasher 10, specifically an automatic dishwasher, according to an embodiment of the present disclosure. The dishwasher 10 shares many features of a conventional automatic dishwasher, which will not be described in detail herein except as necessary for a complete understanding of the disclosure. While the present disclosure is described in terms of a conventional dishwashing unit, it can also be implemented in other types of dishwashing units, such, but not limited to, as in-sink dishwashers, multi-tub dishwashers, or drawer-type dishwashers. A chassis 12 can define an interior of the dishwasher 10 and can include a frame, with or without panels mounted to the frame. For built-in dishwashers, outer panels are typically not needed. For dishwashers that are not built into existing cabinetry, the chassis 12 can include the panels mounted to the frame to form a cabinet for the dishwasher 10. An open-faced tub 14 can be provided within the interior of and mounted to the chassis 12 and can at least partially define a treating chamber 16 or a dish treating chamber for washing or otherwise treating dishes. The open face of the tub 14 defines an access opening for the treating chamber 16.

A closure element, such as a door assembly 18, can be movably mounted to the dishwasher 10 for movement between opened and closed positions. The door assembly 18 can be configured selectively open and close the treating chamber access opening defined by the open face of the tub 14. Thus, the door assembly 18 provides accessibility to the treating chamber 16 for the loading and unloading of dishes or other washable items. It should be appreciated that the door assembly 18 can be secured to the lower front edge of the chassis 12 or to the lower front edge of the tub 14 via a hinge assembly (not shown) configured to pivot the door assembly 18. When the door assembly 18 is closed, user access to the treating chamber 16 can be prevented, whereas user access to the treating chamber 16 can be permitted when the door assembly 18 is open. Alternatively, the closure element can be slidable relative to the chassis 12, such as in a drawer-type dishwasher, wherein the access opening for the treating chamber 16 is formed by an open-top tub. Other configurations of the closure element relative to the chassis 12 and the tub 14 are also within the scope of the disclosure.

Dish holders, illustrated in the form of an upper dish rack 22, a lower dish rack 24, and a third level rack 20, can be located within the treating chamber 16 and receive dishes for treatment, such as washing. The third level, upper, and lower dish racks 20, 22, 24 can be vertically oriented with respect to one another. That is, third level, upper, and lower dish racks 20, 22, 24 can be spaced from one another in a vertical direction denoted by a Z-axis. The third level, upper, and lower dish racks 20, 22, 24 are typically mounted for slidable movement in and out of the treating chamber 16 for ease of loading and unloading. Other dish holders can be provided, such as a silverware basket, separate from or combined with third level, upper, and lower dish racks 20, 22, 24. As used in this description, the term "dish(es)" is intended to be generic to any item, single or plural, that may be treated in the dishwasher 10, including, without limitation, dishes, plates, pots, bowls, pans, glassware, and silverware. While the dishwasher 10 is illustrated herein as having three dish racks 20, 22, 24, it will be understood that any suitable number and configuration of dish racks is also within the scope of the disclosure.

A utensil caddy 70 can be included with the third level rack 20. Specifically, the utensil caddy 70 can be provided on a lateral side of third level dish rack 20. As used herein, the term lateral can denote any direction corresponding to the X-axis. The utensil caddy 70 can be configured to hold a set of utensils so they can be treated within the treating chamber 16. As used herein, the term utensil can refer to any implement, article or container suitable for treatment within the treating chamber 16. For example, the set of utensils can include, but is not limited to, a spoon, a fork, a spork, a knife, a spatula, a baby-bottle nipple, a measuring spoon, a ladle, a tong, or the like. It will be appreciated that there can be any number of one or more utensil caddy's 70 within the treating chamber 16 and included with any of the third level, upper, and lower dish racks 20, 22, 24.

A spray system can be provided for spraying liquid in the treating chamber 16 and may be provided in the form of, for example, an upper spray assembly 26, a middle spray assembly 28, and a lower spray assembly 30. The upper spray assembly 26, the middle spray assembly 28, and the lower spray assembly 30 are located, respectively, above the third level dish rack 20, beneath the upper dish rack 22, and beneath the lower dish rack 24 and are illustrated as rotating spray arms by example but are not limited to such positions and sprayer type. The spray system can further include a rack spray assembly 32 coupled to the third level dish rack 20; the rack spray assembly 32 will be discussed in further detail below. Furthermore, the spray system can include additional and/or alternative spray assemblies. For example, a distribution header or spray manifold can be located at the rear of the tub 14 at any vertical position. An exemplary spray manifold is set forth in detail in U.S. Pat. No. 7,594,513, issued Sep. 29, 2009, and titled "Multiple Wash Zone Dishwasher," which is incorporated herein by reference in its entirety.

A recirculation system can be provided for recirculating liquid from the treating chamber 16 to the spray system. The recirculation system can include a sump 34 and a pump assembly 36. The sump 34 collects the liquid sprayed in the treating chamber 16 and can be formed by a sloped or recess portion of a bottom wall of the tub 14. The pump assembly 36 can include both a drain pump 38 and a recirculation pump 40. The drain pump 38 can draw liquid from the sump 34 and pump the liquid out of the dishwasher 10 to a household drain line (not shown). The recirculation pump 40 can draw liquid from the sump 34, and the liquid can be simultaneously or selectively pumped through a supply conduit or tube 42 to each of the upper, middle, lower, and rack spray assemblies 26, 28, 30, 32 for selective spraying. The liquid supply tube 42 extends along a wall of the tub 14 and fluidly connect the pump assembly 36 to the upper, middle, lower, and rack spray assemblies 26, 28, 30, 32. While not shown, a liquid supply system can include a water supply conduit coupled with a household water supply for supplying water to the treating chamber 16.

While the pump assembly 36 is illustrated herein as having separate drain and recirculation pumps 38, 40, in an alternative embodiment, the pump assembly 36 can include a single pump configured to selectively supply wash liquid to either the spray system or the drain line, such as by configuring the pump to rotate in opposite directions, or by providing a suitable valve system.

A heating system including a heater 44 can be located, for example, within the sump 34 for heating the liquid contained in the sump 34. The heater 44 can also heat air contained in the treating chamber 16. Alternatively, a separate heating element (not shown) can be provided for heating the air circulated through the treating chamber 16. A filtering system (not shown) can be fluidly coupled with the recirculation flow path for filtering the recirculated liquid.

A control system including a controller 46 can also be included in the dishwasher 10, which can be operably coupled with various components of the dishwasher 10 to implement a cycle of operation. The controller 46 can be located within the door assembly 18 as illustrated, or it can alternatively be located somewhere within the chassis 12. The controller 46 can also be operably coupled with a control panel or user interface 48 for receiving user-selected inputs and communicating information to the user. The user interface 48 can include operational controls such as dials, lights, switches, and displays enabling a user to input commands, such as a cycle of operation, to the controller 46 and receive information.

Figure 2:
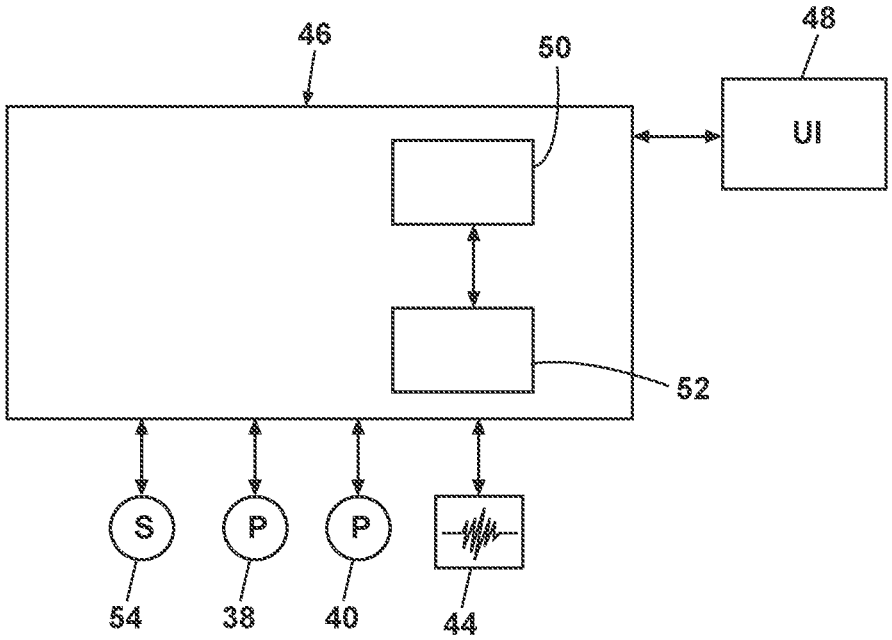
FIG. 2 is a schematic diagram of a control system for the dishwasher of FIG. 1.

FIG. 2 is a schematic illustration of the controller 46 of FIG. 1. The controller 46 can be coupled with the heater 44 for heating the wash liquid during a cycle of operation, the drain pump 38 for draining liquid from the treating chamber 16, and the recirculation pump 40 for recirculating the wash liquid during the cycle of operation. The controller 46 can be provided with a memory 50 and a central processing unit (CPU) 52. The memory 50 can be used for storing control software that can be executed by the CPU 52 in completing an automatic cycle of operation using the dishwasher 10 and any additional software. For example, the memory 50 can store one or more pre-programmed cycles of operation that can be selected by a user and completed by the dishwasher 10. A cycle of operation for the dishwasher 10 can include one or more of the following steps: a wash step, a rinse step, and a drying step. The wash step can further include a pre-wash step and a main wash step. The rinse step can also include multiple steps such as one or more additional rinsing steps performed in addition to a first rinsing. The amounts of water and/or rinse aid used during each of the multiple rinse steps can be varied. The drying step can have a non-heated drying step (so called "air only"), a heated drying step or a combination thereof. These multiple steps can also be performed by the dishwasher 10 in any desired combination.

The controller 46 can also receive input from one or more sensors 54. Non-limiting examples of sensors that can be communicably coupled with the controller 46 include a temperature sensor and turbidity sensor to determine the soil load associated with a selected grouping of dishes, such as the dishes associated with a particular area of the treating chamber 16.

The dishwasher 10 can include all of the above exemplary systems, a selection of the above exemplary systems, and/or other systems not listed above as desired. Further, some of the systems can be combined with other systems and/or can share components with other systems. Examples of other systems that the dishwasher can further include are a dispensing system that supplies one or more treating agents or chemistries to the treating chamber 16 and an air supply system that can provide air, which can be heated or not heated, to the treating chamber 16, such as for drying and/or cooling the dishes. An exemplary air supply system is set forth in U.S. patent application Ser. No. 12/959,673, filed Dec. 3, 2010 and published as U.S. Patent Application Publication No. 2012/0138106 on Jun. 7, 2012, both of which are incorporated herein by reference in their entireties.

Figure 3:
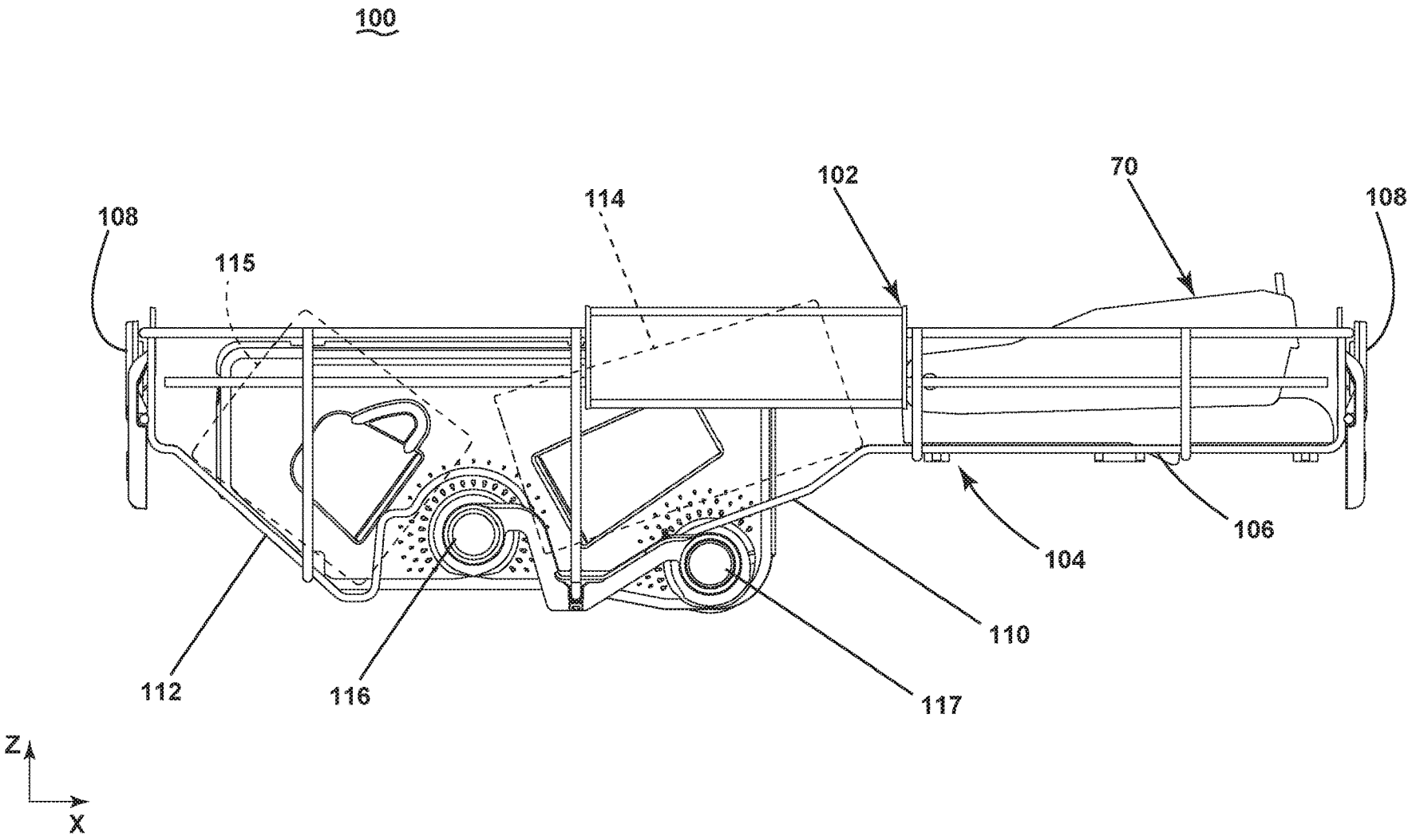
FIG. 3 is a side view of a dish rack assembly including the dish rack of FIG. 1 with a utensil caddy according aspects of the disclosure.

FIG. 3 illustrates a side view of a dish rack assembly 100 including the utensil caddy 70 of FIG. 1 and a dish rack 102. It will be appreciated that the dish rack assembly 100 can include any dish rack 102 as described herein. For example, the dish rack 102 can be any of the upper or lower dish racks 22, 24, or the third level rack 20.

The dish rack 102 has a wire frame construction forming a bottom wall 104 from which extends a peripheral wall 108 defining the sides of the dishrack. The bottom wall 104 and peripheral wall 108 define an interior where utensils and the like can be placed for washing.

While the bottom wall 104 can have any shape, including planar, the bottom wall 104 is illustrated as having a planar portion 106 and a depression defined by a first and second angled wall 110, 112. The depression, as illustrated, forms a first set of cup seats 114 and a second set of cup seats 115, which hold cups as illustrated.

The bottom wall 104 can define multiple planes. For example, the planar portion 106 can define a first plane transverse to the X-axis, while the first angled wall 110 can define a second plane and the second angled wall 112 can define a third plane. The second and the third planes can both be angled with respect to the X-axis such that they intersect with the first plane. Specifically, the second plane can intersect the first plan at the point where the planar portion 106 and the first angled wall 110 meet.

A spray assembly is carried by the dish rack 102 and includes first and second sprayers 116, 117, with the first sprayer 116 located between the first and second set of cup seats 114, 115 to emit a spray into the open top of the cups, and the second sprayer 117 located to emit a spray into the planar portion 106.

The utensil caddy 70 can be received within a region of the dish rack 102 adjacent to a portion of the bottom wall 104, specifically the planar portion 106. It is contemplated that the utensil caddy 70 can be removably mounted to a portion of the dish rack 102, specifically the planar portion 106. As such, the utensil caddy 70 can be moved to other portions of the dish rack 102 or to another dish rack 102 altogether. Alternatively, at least a portion of the utensil caddy 70 can be integrally formed with the planar portion 106 and hence the dish rack 102. It is further contemplated that the utensil caddy 70 can be laid on its side or otherwise be defend as a horizontal utensil caddy such that utensils can be received within the utensil caddy 70 in a horizontal fashion transverse to the X-axis. Traditional utensil caddies, on the other hand, are vertically mounted such that they can be defined as a vertical utensil caddy. As such, utensils can be received within the vertical utensil caddy in a vertical fashion transverse to the Z-axis.

Figure 4:
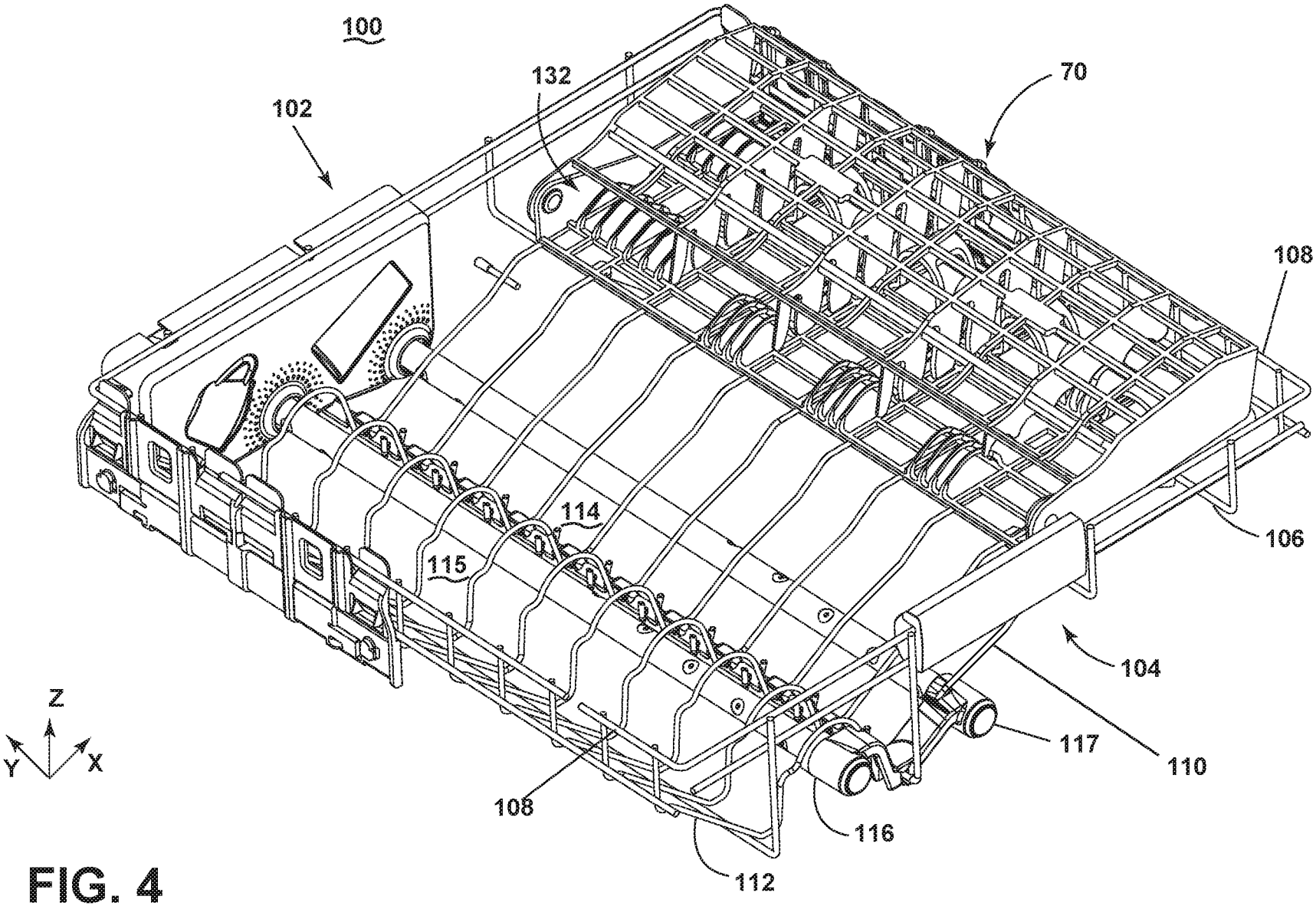
FIG. 4 is a perspective view of the utensil caddy of FIG. 3 in a first position according to aspects of the disclosure.

FIG. 4 is a perspective view of the dish rack assembly 100 of FIG. 3 including the utensil caddy 70 in a first position. As used herein, the first position can be defined as a closed configuration of the utensil caddy 70 where at least a portion of the utensil caddy 70 abuts a portion of the bottom wall 104 and does not abut the first angled wall 110. As illustrated, the first and second set of cup seats 114, 115, the first and second sprayers 116, 117, and the utensil caddy 70 can extend along the entirety of the dish rack 102 along the Z-axis.

The utensil caddy 70 can include a periphery defining an interior with an open top 132. The open top 132 can be defined as a portion of the utensil caddy 70 in which utensils can be passed through. The open top 132 can lie at a junction point between the first plane of the planar portion 106 and the second plane of the first angled wall 110.

Figure 5A:
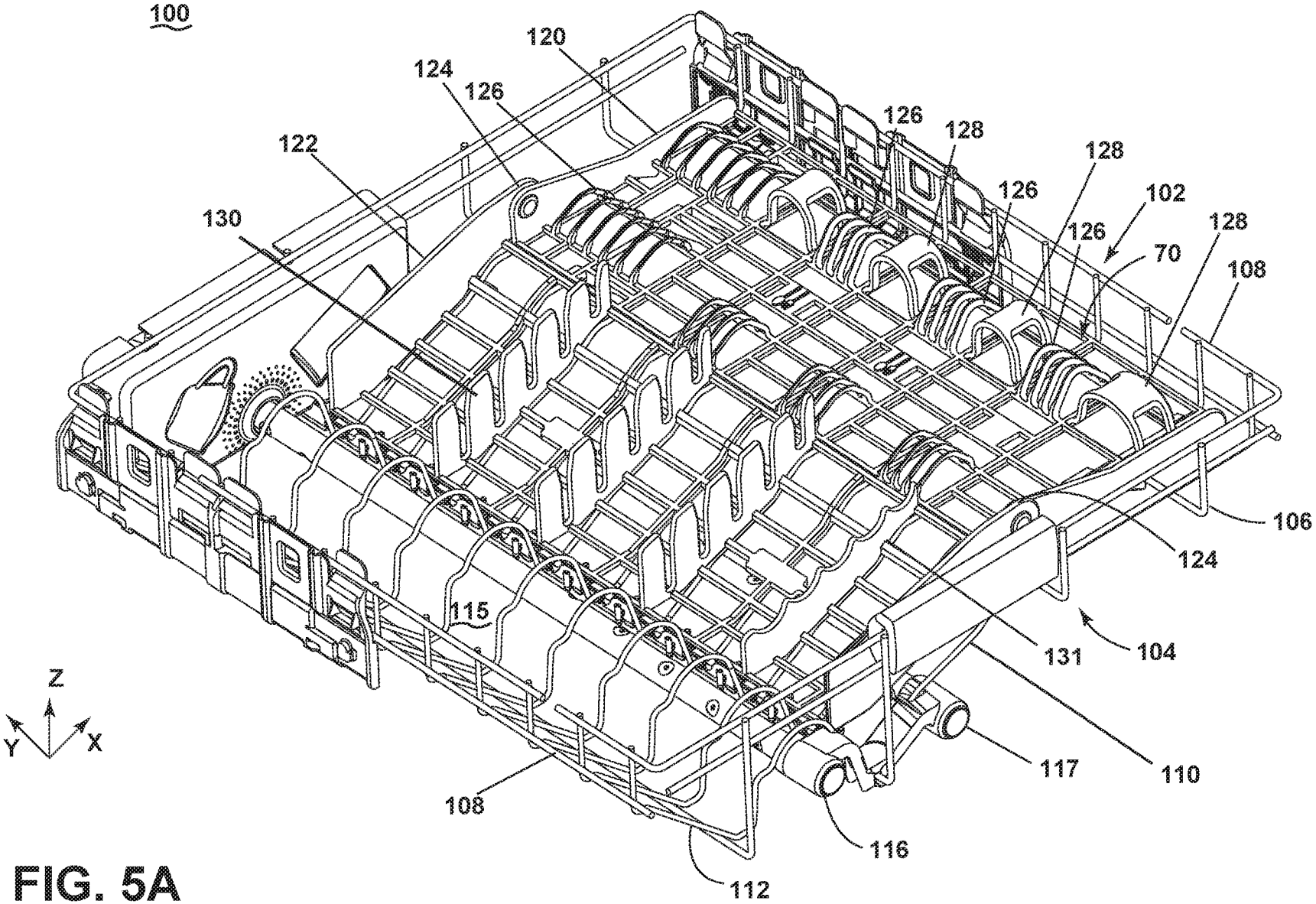
FIG. 5A is a perspective view of the utensil caddy of FIG. 3 in a second position according to aspects of the disclosure.

FIG. 5A is a perspective view of the dish rack assembly 100 of FIG. 3 including the utensil caddy 70 in a second position. The second position can be defined as an open configuration of the utensil caddy 70 where at least a portion of the utensil caddy 70 is carried by, received on, or abuts a portion of the bottom wall 104, specifically the first angled portion 112 as illustrated. It will be appreciated that the utensil caddy 70 can be advantageously shaped so that a portion of the utensil caddy 70 can transition from the closed or first position to the opened or second position and conform with the first angled wall 110.

Figure 5B:
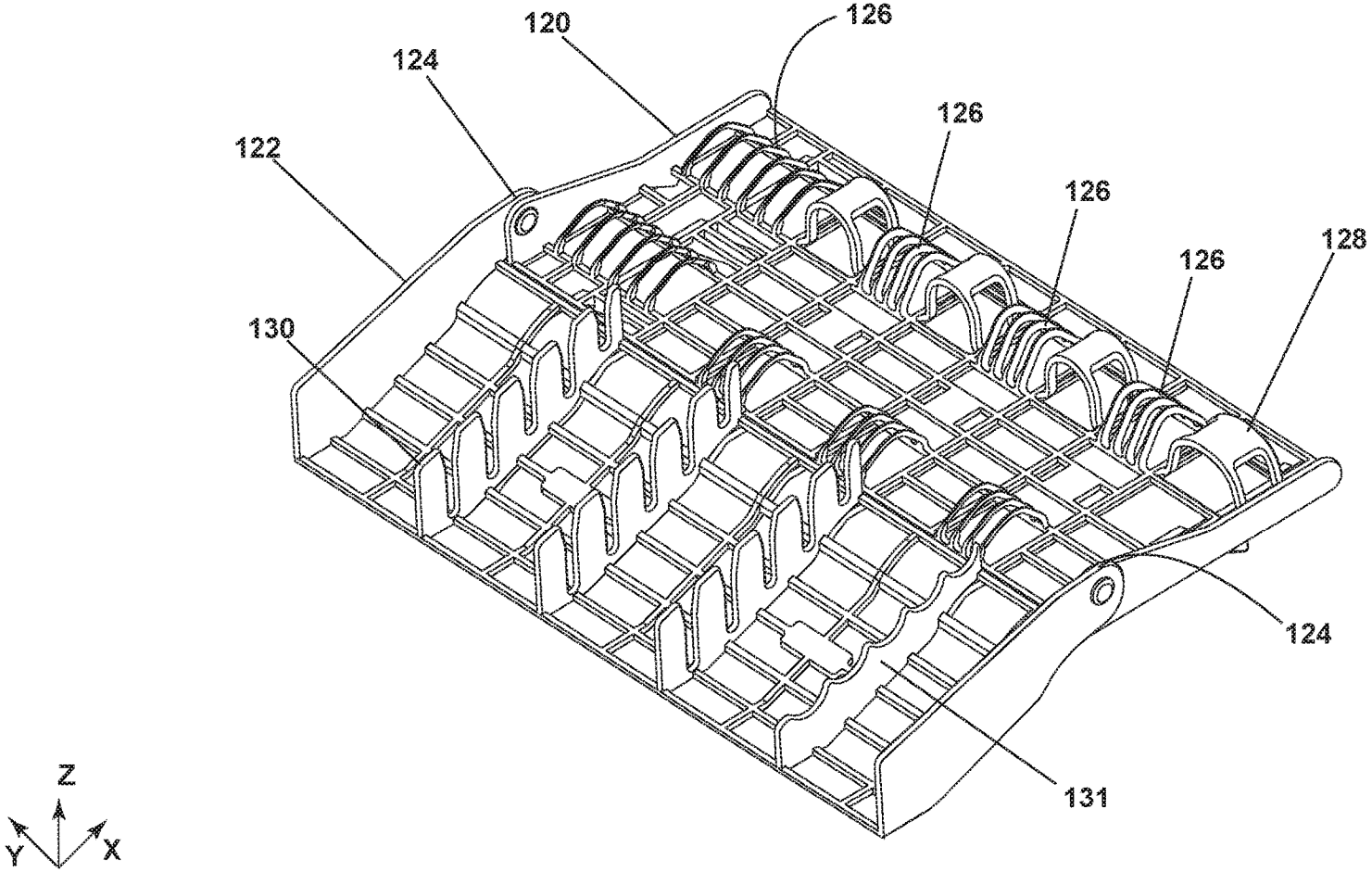
FIG. 5B is a perspective view of the utensil caddy in the second position of FIG. 5*a* according to aspects of the disclosure.

FIG. 5B is a perspective view of the utensil caddy 70 in the second position of FIG. 5A without the dish rack 102. The utensil caddy 70 can include a first side wall 120, a second side wall 122, and a set of hinges 124.

The first side wall 120 can rest on, be directly coupled to, or form a portion of the bottom wall 104 of the dish rack 102, specifically, the planar portion 106. The first side wall 120 can include a first set of utensil holders illustrated as a set of utensil seats 126 or loops 128. The utensil holders can be configured to retain or hold a set of utensils such as, but not limited to, spoons, forks, sporks, knives, ladles, spatulas, or the like. Specifically, the set of utensil seats 126 can be configured to hold smaller utensils (e.g., spoons, forks, sporks, etc.) while the loops 128 can be configured to hold larger utensils (e.g., spatulas, ladles, whisks, etc.). Although illustrated as four separate loops 128 and four sets of utensil seats 126, it will be appreciated that there can be any number of loops 128 or utensil seats 126 provided on the first side wall 120. It will be further appreciated, that one or more of the sets of utensils seats 126 can be provided between adjacent loops 128 as illustrated.

The second side wall 122 can be configured to rotate along the Y-axis about the set of hinges 124 and with respect to the first side wall 120. As such, the second side wall 122 can be moveable between the first position where at least a portion of the second side wall 122 abuts the first side wall 120, and the second position where at least a portion of the second side wall 122 rests against or abuts the bottom wall 104, specifically against the first angled portion 112. As illustrated, the second side wall 122 can overlie the entire first set of cup seats 114 and not overlie the second set of cup seats 115 when in the second position.

The second side wall 122 can further include a second set of utensil holders illustrated as a pin 130 and a seat 131. The pin 130 can be formed as a triangular projection extending from a surface while the seat 131 can be formed as a curved projection of the second side wall 122. A space or slot can be included between adjacent pins 130. As such, the slot can be configured to accept the blade of a knife while the seat 131 accept the handle of the knife, as illustrated. Additionally, or alternatively, the utensil holders of the second side wall 122 can be configured to hold the any suitable utensils such as, but not limited to, a spatula, a ladle, or the like.

The first side wall 120 and the second side wall 122 can be coupled together through the set of hinges 124, specifically two hinges 124 provided on either distal end of the utensil caddy 70 along the Y-Axis. The set of hinges 124 can act as a method of coupling or a point of connection between first side wall 120 and the second side wall 122 and also provide for rotational movement about the Y-Axis for the second side wall 122 with respect to the first side wall 120. As such, the second side wall 122 can pivot from the first position to the second position.

Figure 6:
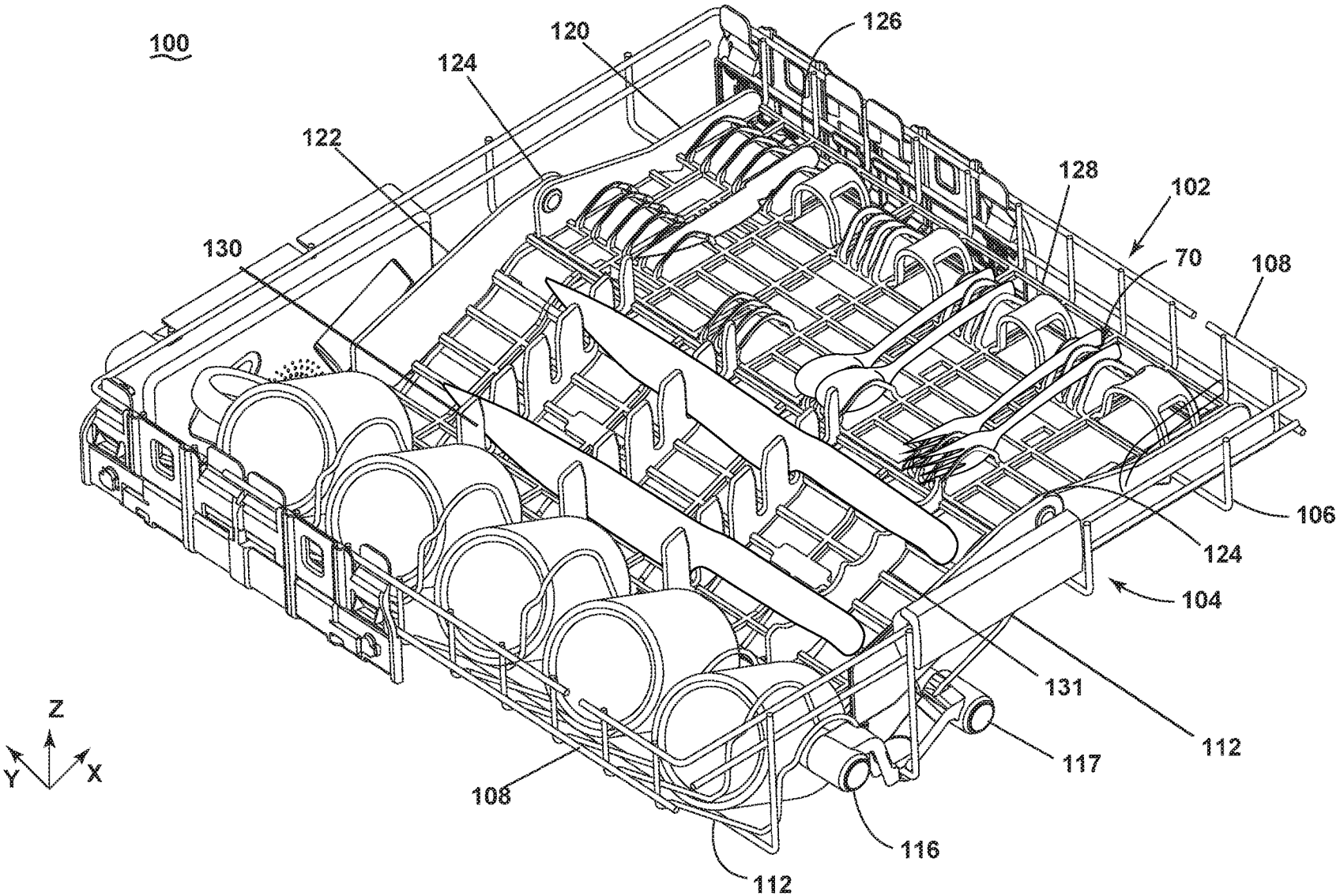
FIG. 6 is a perspective view of the utensil caddy in the second position of FIG. 5 including utensils according to aspects of the disclosure

FIG. 6 is a perspective view of the dish rack assembly 100 of FIG. 3 in the first position and including various sets of utensils received within the utensil caddy 70 in the first position. As illustrated, a set of cups is received within the first set of cup seats 114, and a set of mugs is received within the second set of cup seats 115. Further, a set of utensils are received within the utensil caddy 70, specifically, a set of knives, forks, and spoons are received within the set of utensil seats 126 and a set of larger knives are received within the second utensil holders, specifically the pins 130 and the seats 131. It will be appreciated, however, that other such as sporks, measuring cups, or the like can be received within the utensil seats 126 and larger utensils such as spatulas, ladles, or the like can be received within the loops 128. It will be further appreciated that although illustrated as cups and mugs either the first or the second set of cup seats 114, 115 can receive other objects to be treated within the treating chamber 16 such as, but not limited to, baby bottles, plates, bowls, pans, or the like.

A diffuser section can be included within a portion of the utensil caddy 70, specifically a portion of the second side wall 122. The diffuser section can be defined as a portion of the utensil caddy 70 which directly contacts a stream of water from one or more of the first and second sprayers 116, 117. The stream of water emitted from the first and second sprayers 116, 117 can, in some instances, be defined as a straight-line stream of water. This straight-line stream of water can be used to effectively clean targeted portions of various utensils, cups, mugs, or plates within the treating chamber 16. It is contemplated, however, that placing a portion of the utensil caddy 70, specifically the diffuser section on the second side wall 122, in the path of the stream of water can diffuse the stream of water outward to form a fan pattern covering a larger area than the straight-line stream can be more effective at cleaning various utensils. For example, if it is desired to clean a spatula or other utensils with a large surface area, at least a portion of the stream of water from the first and second sprayers 116, 117 that is directed toward the spatula can impact the diffuser region of the utensil caddy 70. Once the stream of water hits the diffuser section, the stream of water can fan-out or form a cone-shaped spray area which can cover a larger surface area than the straight-line stream of water. This, in turn, can be more effective in cleaning utensils on the utensil caddy 70 which have a large surface area than through the use of non-diffused, straight-line stream of water.

In operation, the first and second sprayers 116, 117 or any other sprayer within the treating chamber 16 (e.g., upper, lower, or middle spray assemblies 26, 28, 30) can be configured to treat a set of utensils within a spray zone created by the sprayers. As used herein, the term spray zone can be defined as a region or section within the treating chamber which receives a direct or indirect flow of treating fluid. As such, utensils, cups, plates, or the like, placed within the spray zone will be washed or treated. The utensil caddy 70 can be placed in either the first or second position depending on the utensils which need to be treated. For example, if it is desired to clean a set of mugs and a set of cups, the utensil caddy 70 can be positioned in the first position such that cups and mugs can be placed within the first and second sets of cup seats 114, 115 as illustrated in FIG. 6. On the other hand, if it is desired to clean a set of utensils, the utensil caddy 70 can be positioned in the second position and a set of utensils can be placed within the respective utensil holders or seats, as illustrated in FIG. 6. It is further contemplated that when the utensil caddy 70 is positioned in the second position that only the first set of cup seats 114 are covered by the second side wall 122. As such, cups or mugs can still be received within the second set of cup seats 115.

Figure 7:
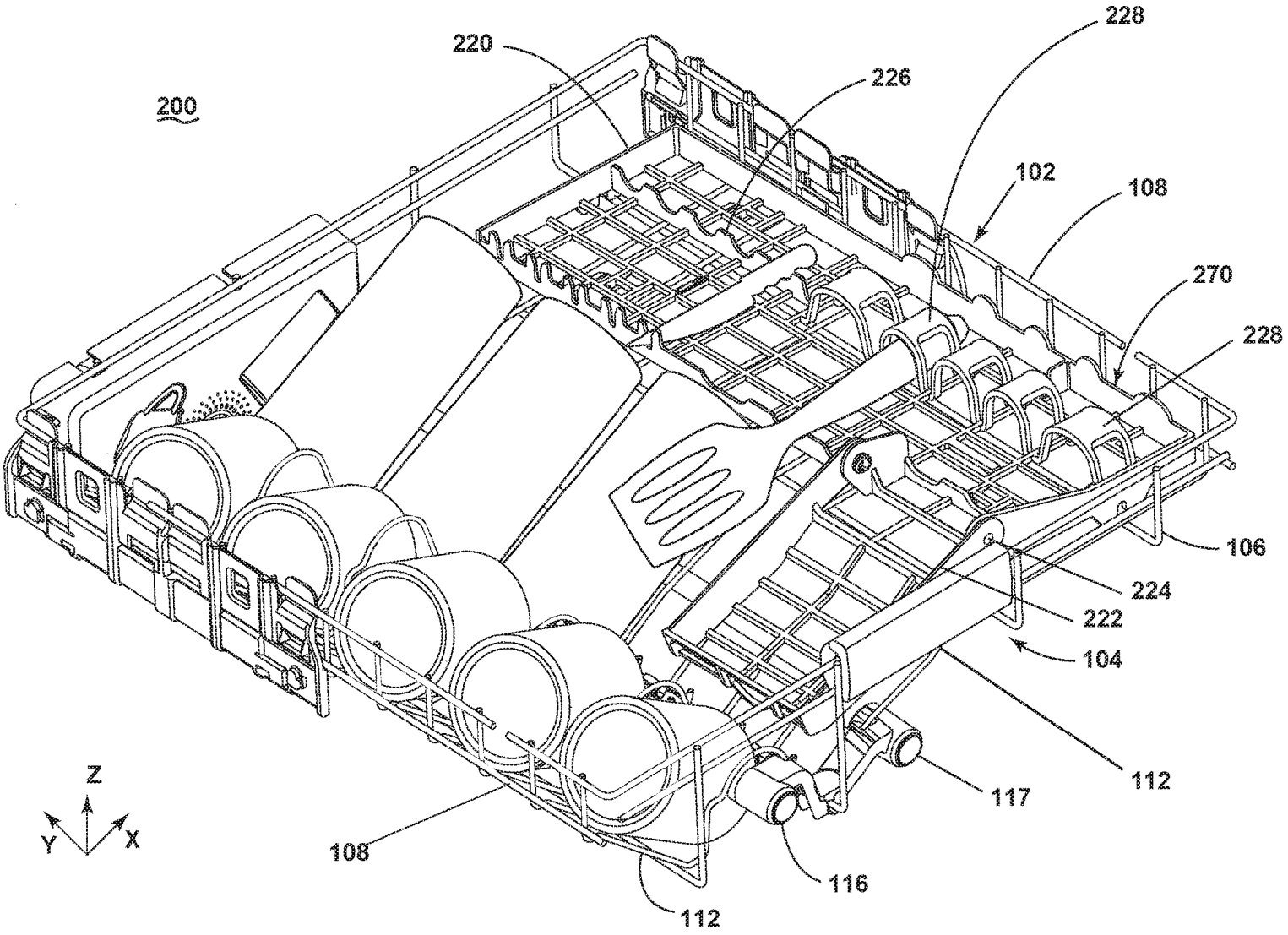
FIG. 7 is a perspective view of the dish rack including an exemplary utensil caddy of FIG. 3 which extends across a quarter of the dish rack assembly according to aspects of the disclosure.
Figure 8:
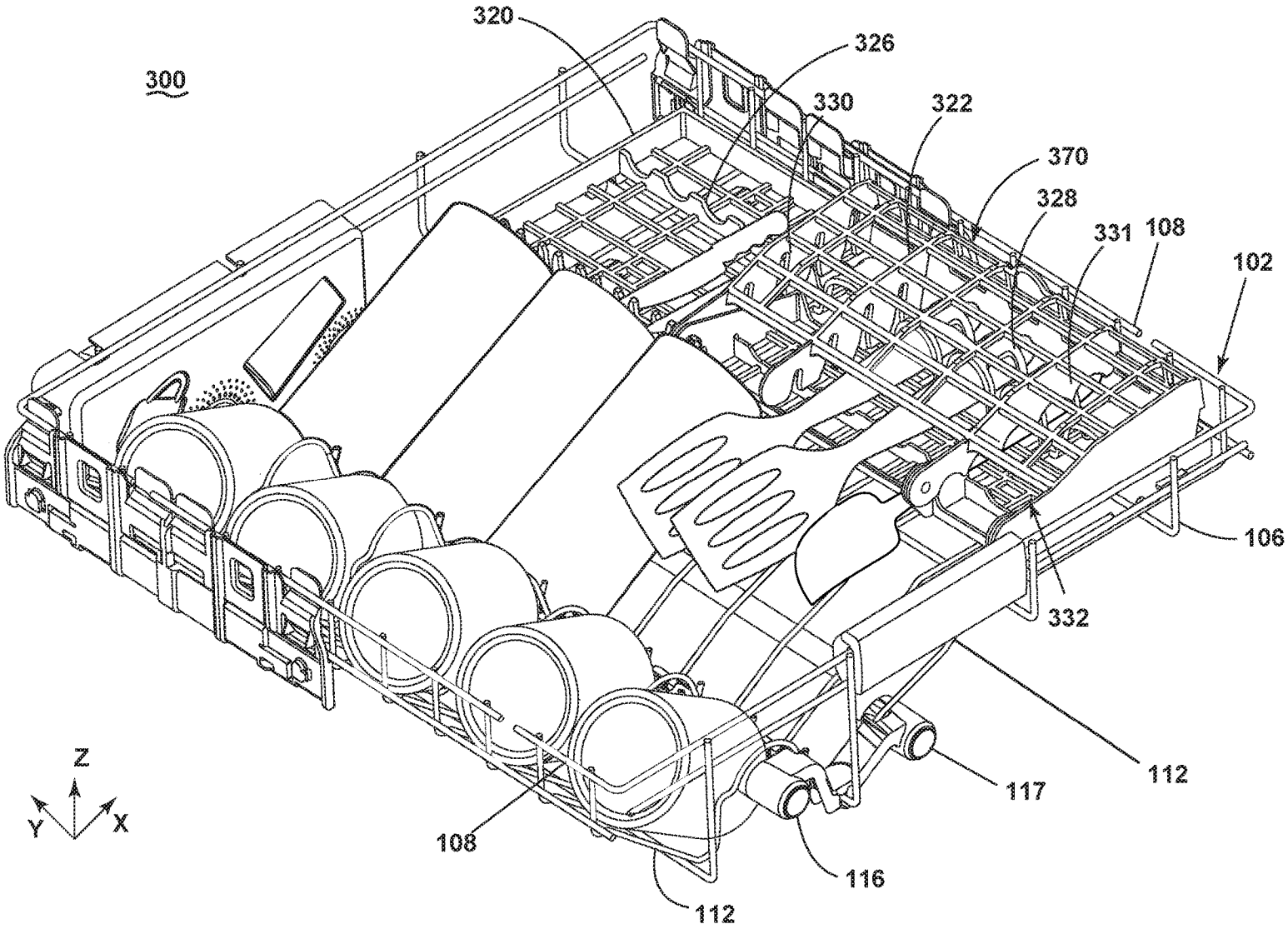
FIG. 8 is a perspective view of the dish rack including an exemplary utensil caddy of FIG. 3 which extends across half of the dish rack assembly according to aspects of the disclosure.

FIG. 7 is a perspective view of a dish rack assembly 200. The dish rack assembly 200 is similar to the dish rack assembly 100; therefore, like parts will be identified by like numerals in the 200 series, with it being understood that the description of the like parts of the dish rack assembly 100 applies to the dish rack assembly 200 unless otherwise noted.

The dish rack assembly 200 includes a utensil caddy 270 which includes a second side wall 222 similar to the second side wall 122 except the overall length along the Y-axis of the second side wall 222 is smaller than the overall length of a first side wall 220 along the Y-axis. Specifically, the second side wall 222 is configured to have an overall length that is a quarter of the overall length of the first side wall 220. As such, when the utensil caddy 270 is in the second position as illustrated, an uncovered portion or an opening is formed within the first set of cup seats 114. This, in turn, ensures that at least a portion of the first set of cup seats 114 are free or open regardless of whether the utensil caddy 270 is in the first position or the second position.

The second side wall 222 can be configured to hold smaller, more delicate utensils than the second side wall 122. For example, the second side wall 222 can be configured to hold baby bottle nipples, caps, burrs, or the like. Additionally, or alternatively, the second side wall 222 can include a utensil holder similar to a utensil loop 228 or a utensil seat 226 to hold a set of utensils.

FIG. 9 is a perspective view of a dish rack assembly 300. The dish rack assembly 300 is similar to the dish rack assembly 100, 200; therefore, like parts will be identified by like numerals in the 300 series, with it being understood that the description of the like parts of the dish rack assembly 100, 200 applies to the dish rack assembly 300 unless otherwise noted.

The dish rack assembly 300 includes a utensil caddy 370 which includes a second side wall 322 similar to the second side wall 122, 222 except that the second side wall 322 includes an overall length along the Y-axis that is half the overall length of a first side wall 320 along the Y-axis. This is similar to the second side wall 222 in that a portion of the first set of cup seats 114 are free or open regardless of whether the utensil caddy 370 is in the first position or the second position. However, the second side wall 322 includes the overall length of half the overall length of the first side wall 320. This, in turn, allows for larger utensils, such as large knives, to be mounted on the second side wall 322 when the utensil caddy 370 is in the second position while still allowing for at least a portion of the first set of cup seats 114 to be open regardless of the position of the utensil caddy 370.

A set of loops 328 can be provided on the first side wall 320 such that a set of larger utensils, illustrated as three spatulas, can be secured within the utensil caddy 370. It is contemplated, that a set of larger utensils can be secured by the set of loops 328 regardless of whether the utensil caddy 370 is in the first position or the second position. As illustrated, the utensil caddy 370 is in the first position such that a portion of the larger utensils extend beyond the utensil caddy along the X-axis.

Benefits of the present disclosure include a dish rack assembly which is more versatile when compared to traditional dish rack assemblies. For example, traditional dish rack assemblies can include a vertical utensil caddy in a fixed position on the dish rack and a set of cup seats. Utensils can be secured within the utensil caddy while cups and mugs can be provided within the cup seats. The set of cup seats, however, are not configured to receive a set of utensils, so in cases where it is desired to treat a large amount of utensils there may not be adequate space to secure the utensils. The utensil caddy as disclosed herein, however, can be further as a horizontal utensil caddy in that utensils can be horizontally placed within the utensil caddy through the open top when the utensil caddy is in the first position and be laid horizontally across either the first or second side walls when the utensil caddy is in the second position. This allows for a more versatile dish rack assembly as the utensil caddy can be in either the first position or the second position depending on the utensils which are desired to be treated. For example, if a large amount of cups or mugs are desired to be treated, the utensil caddy can be positioned in the first position such that all the cup seats are opened. If, on the other hand, it is desired to treat a large amount of utensils, the utensil caddy can be positioned in the second position and allow for a larger amount of utensils to be secured by the first and second side walls.

Further benefits of this disclosure include the dish rack assembly, specifically the utensil caddy, with an improved washing efficiency of utensils when compared to traditional vertical utensil caddies. For example, in traditional vertical utensil caddies receive or secure the utensils in a vertical fashion. This, in turn, can place portions of the utensils out of the spray zone such that they are not as effectively cleaned. The utensil caddy as described herein, however, ensures that all of the utensils are horizontally secured and that all portions of the utensils which need to be treated are within the spray zone. Further, the utensil caddy can include a diffuser section which can diffuse the streams of water from the sprayers and effectively cover a larger surface area for the treating fluid or water to reach. As such, the washing efficiency of the utensils placed or secured within the utensil caddy can be improved when compared to the traditional vertical utensil caddies.

It will also be understood that various changes and/or modifications can be made without departing from the spirit of the present disclosure. By way of non-limiting example, although the present disclosure is described for use with a wire dish rack, it will be recognized that the rack height adjustment assembly can be employed with various rack constructions, including molded racks, such as racks molded of plastic.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described. All combinations or permutations of features described herein are covered by this disclosure.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

It is intended that the following concepts can define at least a portion of the scope of the disclosure and that the apparatus and/or method(s) within the scope of these concepts and their equivalents be covered thereby. This disclosure should be understood to include all novel and non-obvious combinations of elements described herein, and the concepts may be presented in this or a later application to any novel and non-obvious combination of these elements. Any aspect of any embodiment can be combined with any aspect of any other embodiments. Moreover, the foregoing embodiments are illustrative, and no single feature or element is essential to all possible combinations that may be included in this or a later application. Further aspects of the invention are provided by the subject matter of the following clauses:

1. An automatic dishwasher configured to implement an automatic treating cycle of operation, comprising a tub defining a dish treating chamber, a dish rack located within the dish treating chamber and comprising a bottom wall defining at least one plane, a utensil caddy, removably mounted to the dish rack, and comprising a periphery defining an interior with a top, the periphery having at least first and second opposing side walls, the first side wall abutting the bottom wall, and the second side wall movable relative to the utensil caddy between a first position, in opposition to the first side wall, and a second position, abutting the bottom wall, a first set of utensil holders provided on the first side wall, and a second set of utensil holders provided on the second side wall.

2. The automatic dishwasher of any preceding clause wherein the first set of utensil holders is different from the second set of utensil holders.

3. The automatic dishwasher of any preceding clause wherein the second set of utensil holders is only operationally functional when the second side wall is in the second position.

4. The automatic dishwasher of any preceding clause wherein the first set of utensil holders is nested within the second set of utensil holders when the second side wall is in the first position.

5. The automatic dishwasher of any preceding clause wherein the first set of utensil holders are operationally functional when the second side wall is in the first position.

6. The automatic dishwasher of any preceding clause wherein the second set of utensil holders are operationally non-functional when the second side wall is in the first position.

7. The automatic dishwasher of any preceding clause wherein the second set of utensil holders is provided on both the first and second side walls.

8. The automatic dishwasher of any preceding clause wherein the first set of utensil holders comprise loops extending from the first side wall.

9. The automatic dishwasher of any preceding clause wherein the second set of utensil holders comprise pairs of spaced pins defining a slot to receive at least one of a blade or handle of a utensil.

10. The automatic dishwasher of any preceding clause wherein the slot is configured to receive a blade of a knife and the second set of utensil holders further comprises a handle seat corresponding to the slot, with the handle seat configured to hold the handle of a knife.

11. The automatic dishwasher of any preceding clause wherein the first set of utensil holders are configured to hold utensils in a first longitudinal direction and the second set of utensil holders are configured to hold utensils in a second longitudinal direction, which is different than the first longitudinal direction.

12. An automatic dishwasher configured to implement an automatic treating cycle of operation, comprising a tub defining a dish treating chamber, a dish rack located within the dish treating chamber and comprising a bottom wall defining at least one plane, a first set of cup seats provided in the bottom wall, a utensil caddy, removably mounted to the dish rack, and comprising a periphery defining an interior with an open top, the periphery having at least first and second opposing side walls, the first side wall abutting the bottom wall, and the second side wall movable relative to the utensil caddy between a first position, in opposition to the first side wall, and a second position, abutting the bottom wall and overlying at least some of the cup seats in the first set of cup seats.

13. The automatic dishwasher of any preceding clause further comprising a dedicated sprayer emitting spray into the cup seats to define a spray zone.

14. The automatic dishwasher of any preceding clause wherein the second side wall has a second set of utensil holders which lie within the spray zone when the second side wall is in the second position.

15. The automatic dishwasher of any preceding clause wherein the second set of utensil holders lie outside of the spray zone when the second side wall is in the first position.

16. The automatic dishwasher of any preceding clause wherein the second side wall overlies all of the cup seats in the first set of cup seats when the second side wall is in the second position.

17. The automatic dishwasher of any preceding clause further comprising a second set of cup seats, with the first set of cup seats located between the utensil caddy and the second set of cup seats.

18. The automatic dishwasher of any preceding clause wherein the second side doesn't overlie the second set of cup seats when the second side wall is in the second position.

19. The automatic dishwasher of any preceding clause further comprising a first sprayer, carried by the dish rack, and emitting a spray into the first set of cup seats to define a spray zone.

20. The automatic dishwasher of any preceding clause further comprising a second sprayer, carried by the dish rack, and emitting a spray into the second set of cup seats.

21. The automatic dishwasher of any preceding clause wherein the second side wall overlies all of the first set of cup seats.

22. The automatic dishwasher of any preceding clause wherein the second side wall comprises openings that overlie at least some of the first set of cup seats in the second position.

23. An automatic dishwasher configured to implement an automatic treating cycle of operation, comprising a tub defining a dish treating chamber, a dish rack located within the dish treating chamber and comprising a bottom wall defining at least one plane, and a utensil caddy, removably mounted to the dish rack, and comprising a periphery defining an interior with an open top, the periphery having first and second opposing side walls, the first side wall abutting the bottom wall, and the second side wall movable relative to the utensil caddy between a first position, in opposition to the first side wall, and a second position, abutting the bottom wall.

24. The automatic dishwasher of any preceding clause wherein the dishrack and utensil caddy are arranged such that when the second side wall is in the first position, the utensil caddy overlies a portion of the dish rack to define an uncovered portion of the dish rack.

25. The automatic dishwasher of any preceding clause further comprising a sprayer emitting a spray of liquid into the uncovered portion.

26. The automatic dishwasher of any preceding clause wherein the sprayer is carried by the dish rack.

27. The automatic dishwasher of any preceding clause wherein the bottom wall defines at least a first and second plane, with the second plane oriented at an angle to the first plane.

28. The automatic dishwasher of any preceding clause wherein the first side wall abuts the first plane and the second side wall abuts the second plane in the second position.

29. The automatic dishwasher of any preceding clause wherein the open top lies at a junction of the first and second planes.

30. The automatic dishwasher of any preceding clause wherein the second plane extends downward from the first plane.

31. The automatic dishwasher of any preceding clause further comprising a sprayer emitting spray through the first plane.

32. The automatic dishwasher of any preceding clause wherein the first side wall comprises a first set of utensil holding elements.

33. The automatic dishwasher of any preceding clause wherein the first set of utensil holding elements comprises loops for receiving a handle of a utensil.

34. The automatic dishwasher of any preceding clause wherein the first set of utensil holding elements comprises pairs of pins defining a utensil seat.

35. The automatic dishwasher of any preceding clause wherein the second side wall comprises a second set of utensil holding elements.

36. The automatic dishwasher of any preceding clause wherein the second set of utensil holding elements is are exposed when the second side wall is in the second position.

37. The automatic dishwasher of any preceding clause wherein the second set of utensil holders is configured to hold utensils in an opposite direction than the first set of utensil holders.

38. The automatic dishwasher of any preceding clause wherein the second side wall is pivotally mounted to the utensil caddy.

39. The automatic dishwasher of any preceding clause wherein the second side wall is pivotally mounted to the first side wall.

40. The automatic dishwasher of any preceding clause wherein the second side wall is not coextensive with the first side wall.

41. The automatic dishwasher of any preceding clause wherein the utensil caddy is an openwork.

42. The automatic dishwasher of any preceding clause wherein the open top is generally perpendicular to the at least one plane.

What is claimed is:

1. An automatic dishwasher configured to implement an automatic treating cycle of operation, comprising:

a tub defining a dish treating chamber;

a dish rack located within the dish treating chamber and comprising a bottom wall defining at least one plane;

a utensil caddy, removably mounted to the dish rack, and comprising a periphery defining an interior with an open top, the periphery having at least first and second opposing side walls, the first side wall abutting and laying parallel to the bottom wall, and the second side wall movable relative to the utensil caddy between a first position, in opposition to the first side wall, and a second position, abutting the bottom wall;

a first set of utensil holders provided on the first side wall comprising loops extending from the first side wall, and a second set of utensil holders provided on the second side wall comprising pairs of spaced pins defining a slot to receive at least one of a blade or handle of a utensil.

2. The automatic dishwasher of claim 1 wherein the first set of utensil holders is different from the second set of utensil holders.

3. The automatic dishwasher of claim 2 wherein the second set of utensil holders is only operationally functional when the second side wall is in the second position.

4. The automatic dishwasher of claim 2 wherein the first set of utensil holders is nested within the second set of utensil holders when the second side wall is in the first position.

5. The automatic dishwasher of claim 4 wherein the first set of utensil holders are operationally functional when the second side wall is in the first position.

6. The automatic dishwasher of claim 5 wherein the second set of utensil holders are operationally non-functional when the second side wall is in the first position.

7. The automatic dishwasher of claim 2 wherein the second set of utensil holders is provided on both the first and second side walls.

8. The automatic dishwasher of claim 1 wherein the slot is configured to receive a blade of a knife and the second set of utensil holders further comprises a handle seat corresponding to the slot, with the handle seat configured to hold the handle of a knife.

9. The automatic dishwasher of claim 1 wherein the first set of utensil holders are configured to hold utensils in a first longitudinal direction and the second set of utensil holders are configured to hold utensils in a second longitudinal direction, which is different than the first longitudinal direction.

10. The automatic dishwasher of claim 1 further comprising a first set of cup seats provided in the bottom wall.

11. The automatic dishwasher of claim 10 further comprising a dedicated sprayer emitting spray into the cup seats to define a spray zone.

12. The automatic dishwasher of claim 11 wherein the second side wall has a second set of utensil holders which lie within the spray zone when the second side wall is in the second position.

13. The automatic dishwasher of claim 12 wherein the second set of utensil holders lie outside of the spray zone when the second side wall is in the first position.

14. The automatic dishwasher of claim 12 wherein the second side wall overlies all of the cup seats in the first set of cup seats when the second side wall is in the second position.

15. The automatic dishwasher of claim 10 further comprising a second set of cup seats, with the first set of cup seats located between the utensil caddy and the second set of cup seats.

16. The automatic dishwasher of claim 15 wherein the second side doesn't overlie the second set of cup seats when the second side wall is in the second position.

17. The automatic dishwasher of claim 16 further comprising a first sprayer, carried by the dish rack, and emitting a spray into the first set of cup seats to define a spray zone.

18. The automatic dishwasher of claim 17 further comprising a second sprayer, carried by the dish rack, and emitting a spray into the second set of cup seats.

19. The automatic dishwasher of claim 10 wherein the second side wall overlies at least some of the cup seats in the first set of cup seats.

* * * * *